US007752875B2

(12) United States Patent
Constantinou et al.

(10) Patent No.: US 7,752,875 B2
(45) Date of Patent: Jul. 13, 2010

(54) MULTIPOINT LOCK

(75) Inventors: John Constantinou, Springvale (AU); Hans Juergen Esser, Keysborough (AU)

(73) Assignee: Assa Abloy Australia Pty Limited, Victoria (AU)

( * ) Notice: Subject to any disclaimer, the term of this patent is extended or adjusted under 35 U.S.C. 154(b) by 0 days.

(21) Appl. No.: 10/943,781

(22) Filed: Sep. 17, 2004

(65) Prior Publication Data

US 2005/0092042 A1 May 5, 2005

(30) Foreign Application Priority Data

Sep. 22, 2003 (AU) ..... 2003905148

(51) Int. Cl.
*E05B 59/00* (2006.01)
*E05B 63/14* (2006.01)

(52) U.S. Cl. ..... 70/107; 70/118; 292/41

(58) Field of Classification Search ..... 70/107–110, 70/104, 118; 292/35–37, 32, 41
See application file for complete search history.

(56) References Cited

U.S. PATENT DOCUMENTS

| | | | | |
|---|---|---|---|---|
| 5,265,920 | A * | 11/1993 | Kaup et al. | 70/107 |
| 5,290,077 | A * | 3/1994 | Fleming | 70/108 |
| 5,765,410 | A * | 6/1998 | Kwan et al. | 70/107 |
| 5,819,562 | A * | 10/1998 | Christ | 70/107 |
| 5,878,606 | A * | 3/1999 | Chaput et al. | 70/108 |
| 6,266,981 | B1 * | 7/2001 | von Resch et al. | 70/107 |
| 6,282,929 | B1 * | 9/2001 | Eller et al. | 70/109 |
| 6,289,704 | B1 * | 9/2001 | Collet et al. | 70/107 |
| 6,327,881 | B1 * | 12/2001 | Grundler et al. | 70/107 |
| 6,389,855 | B2 * | 5/2002 | Renz et al. | 70/107 |
| 7,013,688 | B2 * | 3/2006 | Chen | 70/107 |
| 7,404,306 | B2 * | 7/2008 | Walls et al. | 70/107 |
| 7,634,928 | B2 * | 12/2009 | Hunt | 70/107 |
| 2002/0104339 | A1 * | 8/2002 | Saner | 70/108 |

FOREIGN PATENT DOCUMENTS

| | | |
|---|---|---|
| AU | 198664164 | 10/1986 |
| AU | 633318 | 5/1990 |
| AU | 633318 | 1/1993 |
| AU | 694581 | 12/1995 |

(Continued)

OTHER PUBLICATIONS

Letter and enclosures from Australian Patent Office dated Oct. 25, 2007 regarding Application No. 2004-212561 in the name(s) of Assa Abloy Australia Pty Limited.

(Continued)

*Primary Examiner*—Peter M Cuomo
*Assistant Examiner*—Christopher Boswell
(74) *Attorney, Agent, or Firm*—Renner, Otto, Boisselle, & Sklar, LLP

(57) ABSTRACT

A lock for use as a multipoint lock, the lock having:

a lock body, a lock tongue which is moveable between a locking position and a free position, an actuator to move the lock tongue, a deadlocking member in the lock body and which is moveable between a deadlocking position to deadlock the lock tongue and an undeadlocking position, and, attachment means attachable to a remote lock operator to move the operator without any lost motion.

14 Claims, 7 Drawing Sheets

FOREIGN PATENT DOCUMENTS

| | | | |
|---|---|---|---|
| AU | 705149 | | 2/1996 |
| AU | 714565 | | 7/1998 |
| AU | 714565 | | 1/2000 |
| DE | 3836694 | A1 * | 5/1990 |

OTHER PUBLICATIONS

Letter and enclosures from Australian Patent Office dated Nov. 2, 2007 regarding Application No. 2004-212561 in the name(s) of Assa Abloy Australia Pty Limited.

* cited by examiner 51
11
53
50
23
22
21
15
20
18
16
19
17
20
30
10
26
25
29
24
32
31
14
33
34
13
50
12
51
53
51
11
12
51
11
A
19
27
24
30
12
A
SECTION A-A
(LOCKED)
SECTION A-A
(UNLOCKED)

B
A
55
52
51
51
53
54
11
50
27
41
40
44
42
43
12
50
56
53
B
A
SECTION B-B
(LOCKED)
50
SECTION A-A
(LOCKED)
A
51
27
DRIVE
PLATE
A
SECTION B-B
(UNLOCKED)
SECTION A-A
(UNLOCKED)

OPTIONAL JOINT CONCEPTS

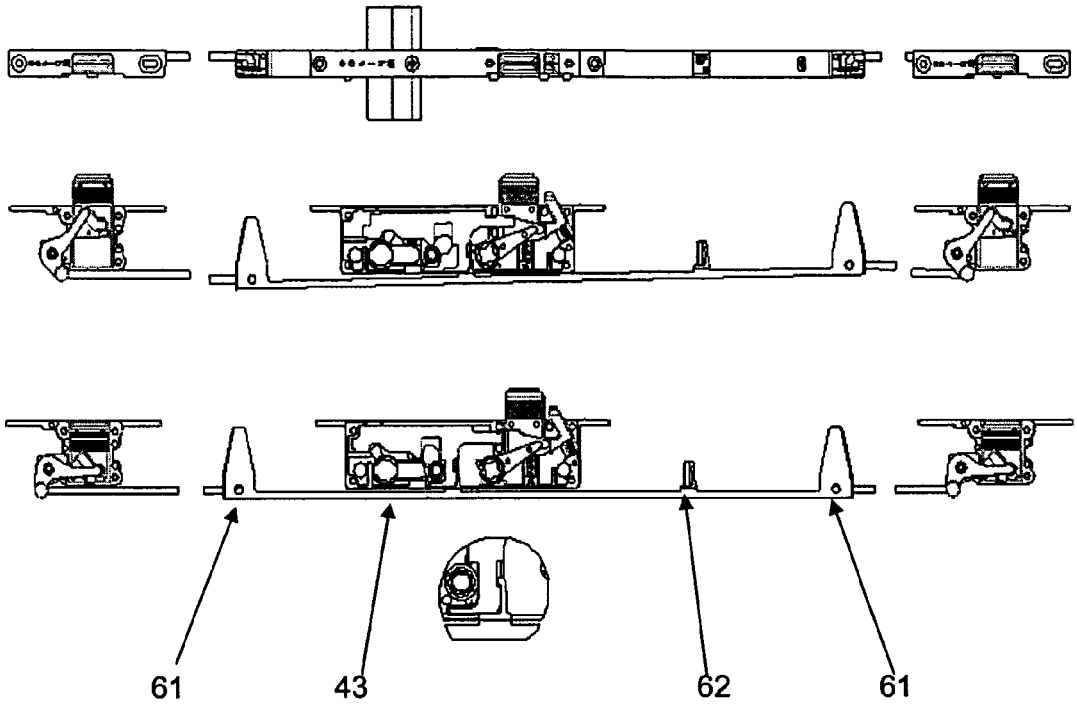
FIG 22 A-C

MULTIPOINT LOCK

FIELD OF THE INVENTION

This invention is directed to a multipoint lock and is particularly directed to a multipoint lock having a main lock and a pair of remote latches, the latches being connected to the main lock by a slide member in a particular manner, thereby allowing the main lock to function either as a multipoint lock or as a normal single lock.

BACKGROUND ART

A multipoint lock typically comprises a central lock and one or more remote latches. The remote latches are operated by operation of the central lock and the remote latches are attached to the central lock via a slide member. This general type of multipoint lock is well known.

The multipoint lock provides improved security to a door by allowing the door to be locked at 2 or 3 spaced apart locations as opposed to a single location. Typically, the central lock is positioned on the door at a normal position and each remote latch is positioned adjacent an upper or lower part of the door.

While multipoint locks provide advantages, fitting of a multipoint lock to a door or window is more complicated than fitting a single lock. One difficulty is that if a pair of remote latches are provided, the latches are "handed" which means that the correct latch must be placed adjacent the top and bottom of the door. Sometimes, the latches are fitted the wrong way round which means that the multipoint lock does not work.

Another difficulty with multipoint locks is attachment of the slides or rods to the central lock and to the latches. The attachment is often finicky and difficult. Also, repair and replacement of multipoint locks can also be quite finicky and difficult due to the difficulty in attaching and releasing the slide or rods, which extend from the central lock to the latches.

Another major disadvantage with multipoint locks is that the central lock needs to be designed specifically for a multipoint lock arrangement. This means that if a multipoint lock is not required, the central lock cannot be used. Therefore, there would be an advantage if it were possible to have a central lock which could function either as a conventional solo lock, or as a multipoint lock.

Australian patent 714689 describes a multipoint lock. The multipoint lock has an internal sliding or rotating deadlocking member. The deadlocking member has a transversely extending finger portion which extends to the rear of the lock. The transversely extending finger portion engages with a pin on an external slide. Thus, movement of the deadlocking member allows the finger portion to push against a pin which can result in operation of the remote latches. However, movement of the deadlocking member in the opposite direction does not result in operation of the deadlocking member. In an attempt to overcome this disadvantage, the same patent describes a further embodiment where the finger portion contains a slot which traps the pin. Therefore, movement of the deadlocking member in either direction can operate the slide. A disadvantage with this arrangement was that the slot has a degree of "lost motion" which means that some movement of the deadlocking member does not result in corresponding operation of the remote latches. Another disadvantage was that the slide was only loosely held and was not fixed to the deadlocking member.

It will be clearly understood that, any prior art publications and referred to herein, does not constitute an admission that any of these publications form part of the common general knowledge in the art in Australia or in any other country.

OBJECT OF THE INVENTION

It is an object of the invention to provide a multipoint lock which may at least partially overcome the above-mentioned disadvantages or provide the public with useful or commercial choice.

In one form, the invention resides in a lock for use as a multipoint lock, the lock having:

- a lock body,
- a lock tongue which is moveable between a locking position and a free position,
- an actuator to move the lock tongue,
- a deadlocking member in the lock body and which is moveable between a deadlocking position to deadlock the lock tongue and an undeadlocking position, and,
- attachment means attachable to a remote lock operator to move the operator without any lost motion.

In another form the invention comprises a multipoint lock assembly comprising a main lock, at least one remote lock and a remote lock operator, the lock having:

- a lock body,
- a lock tongue which is moveable between a locking position and a free position,
- an actuator to move the lock tongue,
- a deadlocking member in the lock body and which is moveable between a deadlocking position to deadlock the lock tongue and an undeadlocking position, and,
- first attachment means attachable to a remote lock operator,
- the remote lock operator having a second attachment means which is attachable to the first attachment means on the lock to move the operator without any lost motion.

The lock can be used as a door lock, a window lock and the like, but the preferred use will be as a multipoint lock for a sliding door (such as a screen door) or a swing door (typically a screen door). The lock is typically fitted to the edge of a metal doorframe such as an extruded aluminium doorframe but no limitation is meant thereby.

The lock has a lock body. The lock body can be any suitable shape or size but is typically substantially rectangular when viewed in plan and typically has a length of between 10-30 centimeters, a width of between 2-10 cm, and a depth of between 1-5 cm. This can of course vary to suit. The lock body is typically made of metal. The lock body may be provided with internal formations to allow assembly of the lock components, this being known in the art.

The lock has a lock tongue which is movable between a locking position and a free position. The lock tongue may be a sliding lock tongue or a rotating lock tongue. If the lock tongue is a sliding lock tongue, it may be provided with a bevelled nose portion. The lock tongue may also be provided with an array of ridges or teeth to increase the security of the lock tongue by locking the lock tongue against the strike if an attempt is made to force the lock tongue. Such an arrangement is known.

If desired, the lock tongue can be movable between a partially extended position and a fully extended position. This can be achieved by having an extending projection/button/member facing the strike which is activated (typically depressed) upon closing of the door which in turn allows the main lock tongue to move from the partially extended position to the fully extended position. Such an arrangement is known.

If the lock tongue is a rotating lock tongue, one or more of such lock tongues may be provided. The rotating lock tongues may be associated with some form of anti slam mechanism or hold back mechanism as is known.

The lock is typically provided with an actuator to move the lock tongue. For a sliding lock tongue, the lock tongue is typically biased into a naturally extending position, and the actuator functions to retract the lock tongue against the bias into be retracted position. Many types of actuators can be provided and a typical actuator comprises a lever which can pivot or rotate to retract the sliding lock tongue. The actuator is typically operated by an external snib or handle or lever.

For a rotating lock tongue, the actuator may comprise a slide in the lock body to which the or each lock tongue is attached. Movement of the slide (typically reciprocal movement) causes the lock tongues to move between the retracted and the extended positions. Again, an external snib or handle or lever can be used to operate the slide. Other types of actuators are envisaged for use with a rotating lock tongue.

The lock contains a deadlocking member which can move between a deadlocking position where the lock tongue is deadlocked and an undeadlocking position. Various types of deadlocking members can be used. One type of deadlocking member may comprise a sliding or reciprocating deadlocking member which can slide between the deadlocking position and the undeadlocking position. Another type of deadlocking member may comprise a rotating deadlocking member. Typically, the deadlocking member comprises a member which has a component of sliding movement and a component of pivoting or rotating movement. The deadlocking member is typically moved between its positions by a snib, a lock barrel, a combination of a snib and a lock barrel, or by some other means. Typically, the deadlocking member can be moved using either a snib or a lock barrel.

The deadlocking member, when in the deadlocked position, may be held in that position against movement to the undeadlocking position. In one form, a stop member can be provided in the lock against which a part of the deadlocking member abuts when the deadlocking member is in the deadlocking position. Therefore, when the deadlocking member is in this position, it cannot be forced or cannot inadvertently move back to the free position. A release means may be provided to allow the deadlocking member to move back to the undeadlocking position. The release means may comprise a lock barrel or some other member.

The lock contains an attachment means. The attachment means is attachable to a remote lock operator to enable the remote lock operator to operate one or more remote locks or latches without any lost motion. It is preferred that the attachment means is operatively associated with the deadlocking member such that movement of the deadlocking member ultimately causes operation of the remote locks. In one form, the attachment means may form part of the deadlocking member may be formed integrally with the deadlocking member.

The deadlocking member may be provided with a part which extends to adjacent a rear portion of the lock (the rear portion is the portion which is the furthest away from the part of the lock which moves towards and away from the strike). The part may comprise a finger portion, a plate portion, or some other portion. Suitably, the part is provided with the attachment means.

The attachment means may comprise any type of attachment means which can engage with a remote lock operator to move the operator without any significant lost motion. It should be appreciated that if the attachment means is part of the deadlocking member, the deadlocking member does not move very significantly in the lock between its deadlocking position and undeadlocking position and therefore an appreciable amount of lost motion can result in failure to properly operate the remote locks upon operation of the deadlocking member.

One type of attachment means may comprise a socket or recess in the deadlocking member and typically on the part of the deadlocking member which is adjacent the rear part of the lock. A projection or like member on the remote lock operator can be held in the socket or the recess to operate the remote locks. The projection or like member is typically such that no lost motion occurs when operating the remote lock operator. Alternatively, the attachment means may comprise a projection, pin, button, knob, finger, or a plurality of such projections which engage with a recess, socket and the like in the remote lock operator. It is also envisaged that the attachment means and the remote lock operator may be provided with a projection etc and a recess etc.

Advantageously, the remote lock operator is able to be attached in such a manner that it cannot readily be removed from the lock. Thus, the attachment means may comprise some form of locking means. The locking means may comprise a press lock arrangement, a twist lock arrangement, a snap lock arrangement, a lock arrangement which requires a separate fastener such as a screw, a slide lock arrangement and the like.

It is possible for the remote lock operator to also be provided with some form of locking means which may be the same as that described above. Suitably, the remote lock operator and the lock are provided with a cooperating locking means.

In another form the invention resides in a multipoint lock assembly which typically comprises a lock as described above, a remote lock operator and at least one remote lock or remote latch (both will be referred to as a remote lock).

The remote lock operator typically comprises a rigid or substantially rigid member or members which extend from the main lock and to the or each remote lock. Typically, the rigid members comprise rods, metal strips, or other rigid or substantially rigid members.

Suitably, the remote lock operator comprises a drive plate member and at least one rod or strip or other like member which is attached to or relative to the drive plate member and to or relative to the or each remote lock. The drive plate member may comprise a substantially flat plate which may be substantially rectangular when viewed in plan. The drive plate member typically extends over the rear portion of the lock, and it is the drive plate which is typically attached to the attachment means in the lock in such a manner that there is little or no lost motion. The drive plate member typically has a size such that it extends slightly from the upper edge of the lock and lower edge of the lock and that conventional rods or strips are used to attach the drive plate member to the remote locks. Therefore, the drive plate member may be provided with some form of means to allow the rods/strips or other members to be attached to the drive plate member. The means will depend on the type of attachment but may comprise some form of small bracket containing an opening to engage with one end of a rod and the like.

The drive plate member may contain a second attachment means which attaches to the attachment means (now called the first attachment means) in the lock. These attachment means may be as described above and may comprise projections, recesses, releasable locking means and the like.

The remote locks typically extend adjacent an upper and lower part of the door or window. Although a single remote lock can be used, it is more common to provide a pair of remote locks.

There is an advantage in having movement of the drive plate member in one direction operating all the remote locks in the same manner. For instance, there is an advantage in having sliding movement of the drive plate member in one direction causing all the remote locks to move from the locked to the unlocked position, and having sliding movement of the drive plate member in the opposite direction causing all the remote locks to move from the unlocked position to the locked position. This avoids the need for complicated drive mechanisms.

However, one disadvantage with this desired movement is that it is necessary to have different lock designs for the upper lock and the lower lock. This is because sliding of the drive plate member in one direction causes one rod to be pushed and the other rod to be pulled. Thus, it is necessary to have a different lock design for each remote lock in order to have the lock tongues both moving out or both moving in notwithstanding that one rod is pushed and one rod is pulled. In the past, it was necessary to provide different remote locks, and this presents the disadvantage that there is always the possibility of the wrong remote lock being installed in the upper or the lower part of the door or window.

Attempts have been made to make the remote locks "non handed" which means that the same lock can be used in the upper part of the door or the lower part of the door. One way has been to insert the lock upside down and this does not always lead to a satisfactory outcome. Other types of remote locks have an unusually complicated mechanism to enable the same lock to be fitted to the top and bottom of the door or window.

Another form of the present invention is directed to a remote lock which is of a fairly simple design and which can be fitted to the top and bottom of a door or window without modification. Typically, the lock can be fitted in the same orientation and does not need to be fitted upside down. This allows installation to be conducted more conveniently and with greater reliability.

Typically, the remote lock according to this form of the invention contains a recess which allows the rod to extend over the lock body to engage with an actuating arm.

Therefore, in another form, the invention resides in a remote lock, the remote lock comprising a lock body, a lock tongue which is movable between a locking position and an unlocking position, an actuating member which operates the lock tongue between the locking position and the unlocking position, attachment means on the actuating arm to enable a rod to be attached to the actuating member, and a recess in the lock body to accommodate the rod and to enable the rod to pass over the lock body without substantially projecting out of the confines of the lock body.

By having the recess in the lock body, and typically extending along a rear wall of the lock body, the rod can now extend over the lock body to engage with the actuating member without projecting from the lock body. It should be appreciated that when the remote lock is fitted to an aluminium security door, there is not enough room to allow the rod to extend over the top of the lock body. There is also not enough room to allow the rod to extend along the rear of the lock body as to enable the remote lock to be strong, it substantially fills the metal frame of the door.

The lock tongue of the remote lock may be a sliding lock tongue or a rotating lock tongue.

The lock body of the remote lock typically has a substantially flat front face and a substantially flat rear face.

The actuating member typically comprises an angled member which may be substantially L-shaped or substantially V-shaped. One arm of the angled member engage with a rear portion or other portion of the lock tongue and the other arm of the angled member may be attachable to the rod. The actuating member may therefore rock or pivot about a pivot axis to operate the lock tongue between the locked position and the unlocked position.

BRIEF DESCRIPTION OF THE DRAWINGS

Embodiments of the invention will be described with reference to the following drawings in which:

FIGS. 22A-C. Illustrate a modified remote lock operator.

BEST MODE

Figures 1, 2, 3, 4:
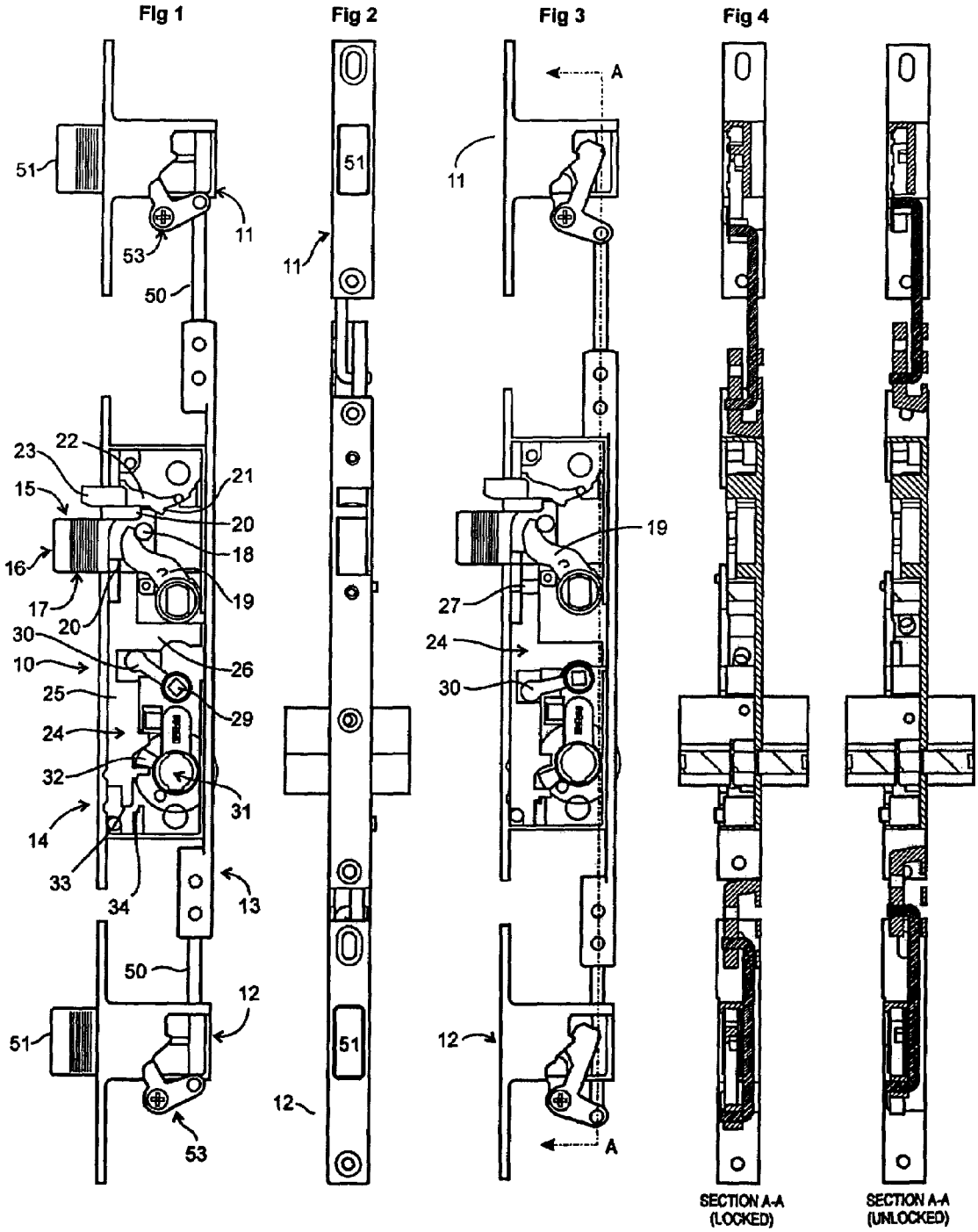
FIG. 1. Illustrates a multipoint lock assembly comprising a central main lock and a pair of remote locks with the locks being in the locked position.
FIG. 2. Illustrates a front view of the multipoint lock assembly of FIG. 1.
FIG. 3. Illustrates the multipoint lock assembly of FIG. 1 with the remote locks being in the unlocked position.
FIG. 4. Illustrates a front view of the lock assembly of FIG. 3.

Referring to the drawings and initially to FIGS. 1-4 there is illustrated a multipoint lock assembly which comprises a central or main lock 10 and a pair of remote locks 11, 12 which are connected to lock 10 by a remote lock operator 13.

Lock 10 in the particular embodiment has a lock body 14 typically formed of metal and which is substantially rectangular when viewed in plan. Inside lock body 14 is a number of projections, flanges, ribs, apertures and the like to enable the various lock components to be fitted to the lock body.

Lock 10 has a lock tongue 15 which in this particular embodiment is a sliding lock tongue and which can slide (or, perhaps more correctly, reciprocate) between an extended locking position illustrated in FIG. 2 and FIG. 3 and a retracted unlocking position (not illustrated but where the lock tongue has been partially or fully retracted into the lock body). Lock tongue 15 is made of steel, has a bevelled nose portion 16 and an array of teeth or ridges 17 extending behind the bevelled nose portion 16. This arrangement is already known and the teeth or ridges function to resist forcing of the lock tongue. The rear portion of lock tongue 15 has a recess and in the recess is a extending post 18. Post 18 provides an engagement for an actuator 19 to retract the lock tongue 15 back into the lock body. Lock tongue 15 is biased by a spring (not illustrated) into a naturally extending position illustrated in FIG. 1, and actuator 19 functions to pull lock tongue 15 back to the unlocked position and against the bias of the spring. The actuator 19 comprises an arm member one end of which engages against post 18. The other end of the arm member engages with an external handle or lever (not illustrated) such that rotation of the external handle or lever causes actuator 19 to retract lock tongue 15. Lock tongue 15 can be held in a partially open position by having a shoulder portion 20 engaging with a shoulder portion 21 on a release member 22. Release member 22 is released upon depression of a small extending button 23. As the door is closed, button 23 is depressed which raises release member 22 to free lock tongue 15 to move under the bias of the spring into the fully locked position. This arrangement is already known.

Lock tongue 15 can be deadlocked in the extended position by a deadlocking member 24. Deadlocking member 24 comprises a plate like metal member which has a main body portion 25 in a forward part of the lock, but which also contains a finger portion 26 which extends across the lock and to the rear part of the lock. Deadlocking member 24 can move between a forward deadlocking position illustrated in FIG. 1 and a retracted undeadlocking position illustrated in FIG. 3. Specifically, deadlocking member 24 has a forward nose portion 27 which extends into a recess in lock tongue 15 when the deadlocking member is in the deadlocking position illustrated in FIG. 1 and therefore prevents lock tongue 15 from being retracted. When deadlocking member 24 has been retracted to the undeadlocking position, nose portion 27 is spaced away from lock tongue 15 and lock tongue 15 can now be retracted by the actuating member 19 to the unlocked position.

Deadlocking member 24 is movable towards its deadlocking position either by rotation of a snib or by rotation of a key barrel. Specifically, an external snib (not illustrated) can be operated by a person. The external snib has a rectangular pin portion which extends into a rectangular bore 29 which forms part of an internal lever 30. Lever 30 can then rotate or rock between the position illustrated in FIG. 1 and the position illustrated in FIG. 3. As the lever is rotated to the position illustrated in FIG. 1, it pushes deadlocking member 24 into the deadlocking position. Conversely, as the lever is rotated to the position illustrated in FIG. 3, it pushes the deadlocking member 24 into the undeadlocking position. Thus, the deadlocking member can be operated by an external snib which operates the internal lever 30.

The deadlocking member 24 can also be operated by a key barrel 31. Key barrel 31 operates a rotatable cam 32. Cam 32 can rotate between the position illustrated in FIG. 1 where it pushes the deadlocking member into the deadlock position, and the position illustrated in FIG. 3 where it pulls the deadlocking member into the undeadlocking position. The cam is operated by an external key which can be pushed into the key barrel and rotated.

Deadlocking member 24 can be held in the deadlock position against inadvertent movement to the undeadlocking position. This is achieved by having the lowermost portion of the deadlocking member provided with a land portion 33. Land portion 33 engages with a small step shoulder 34 which is formed in the lock body. When in this position, the deadlocking member cannot be retracted to the undeadlocking position. Moreover, the internal lever 30 can not be manipulated to move the deadlocking member back into the undeadlocking position due to engagement of land portion 33 against shoulder 34. The only way that the deadlocking member can be retracted to the undeadlocking position is by operation of the key barrel as the cam 32 will push the deadlocking member 24 away from engagement with shoulder 34 as well as retracting the deadlocking member back to the undeadlocking position.

Figures 11, 12, 16:
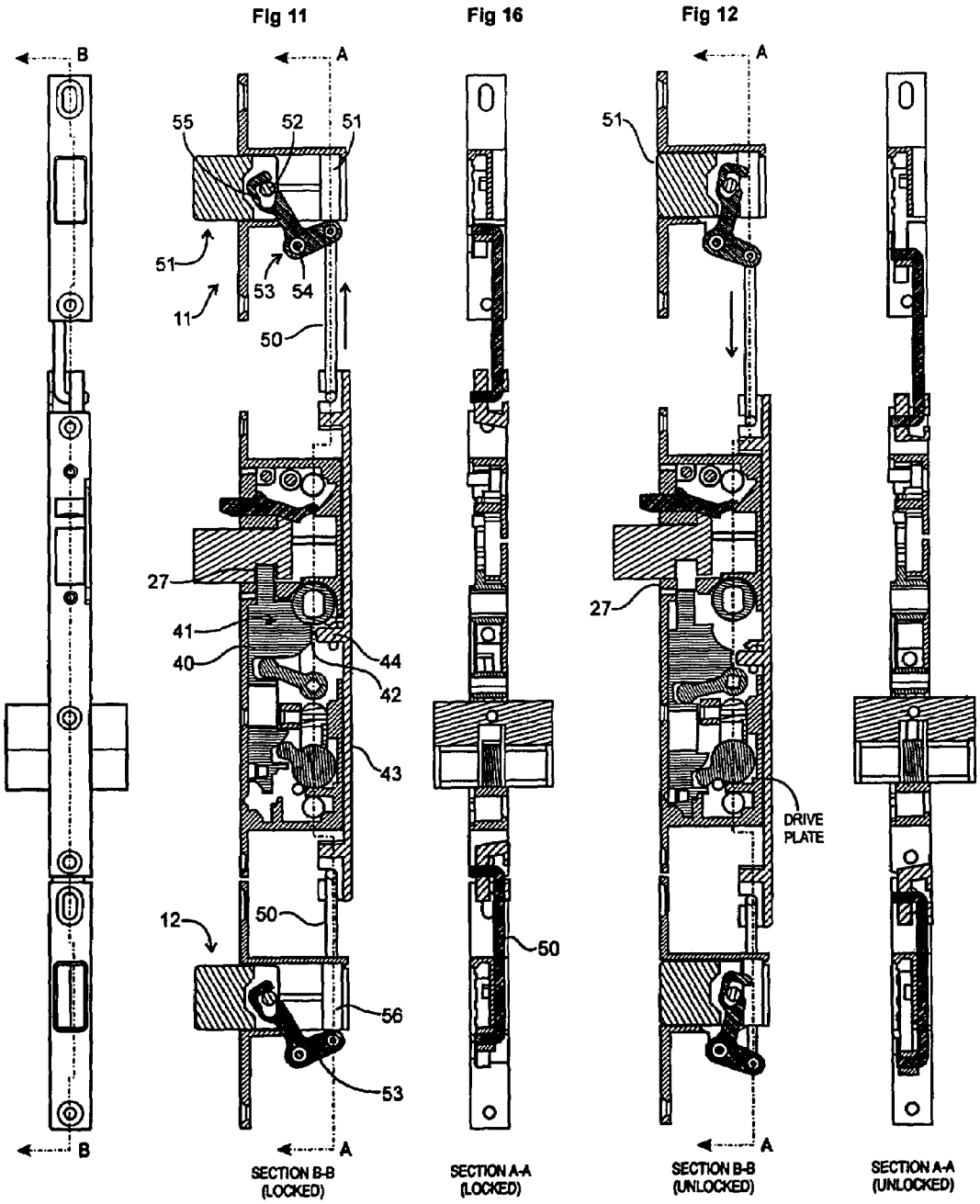
FIG. 11. Illustrates a lock according to a second embodiment of the invention in the locked position.
FIG. 12. Illustrates the lock of FIG. 11 in the unlocked position.
FIG. 16. Illustrates an end view of the remote locks showing that the rod does not project from the confines of the remote lock.

The deadlocking member is provided with the finger portion 26 which extends to the rear part of the lock. The connection between this portion and the remote lock operator 13 is better described with reference to FIGS. 11-15. Referring initially to FIG. 11, there is illustrated a lock which has a different design to the lock illustrated in FIG. 1 and in FIG. 3 but which functions according to the same principle. In FIG. 11, the deadlocking member 14 has a much larger and broader part 41 which extends to the rear of the lock body. This much larger and broader part 41 provides strength to the deadlocking member 14 as the deadlocking member 40 must now take the forces and strains to lock the remote locks as will be described in greater detail below. Part 41 has an attachment means which is attachable to the remote lock operator to move the operator without any lost motion. In the embodiment illustrated in FIG. 11, the attachment means comprises a socket 42.

The remote lock operator 13 comprises a central drive plate member 43. Drive plate member 43 can reciprocate along the rear wall of the lock body. Drive plate member 43 in the embodiment illustrated in FIG. 11 has a projection 44 which fits into socket 42 in part 41. The two parts fit together in such a manner that there is little or no lost motion. Thus, movement of the deadlocking member 40 into the deadlocking position illustrated in FIG. 11 causes the drive plate member 43 to move in the same direction. Conversely, movement of the deadlocking member 40 into the undeadlocking position illustrated in FIG. 12 causes the drive plate member 43 to move in that same direction.

Figure 13:
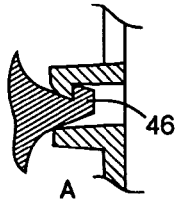
FIGS. 13-15. Illustrate other attachments of the deadlocking member to the slide.
Figure 14:
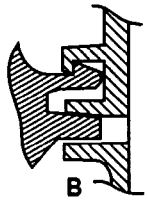
Figure 15:
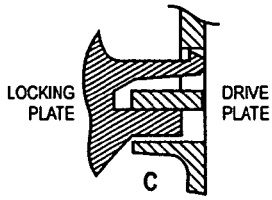
Figure 5:
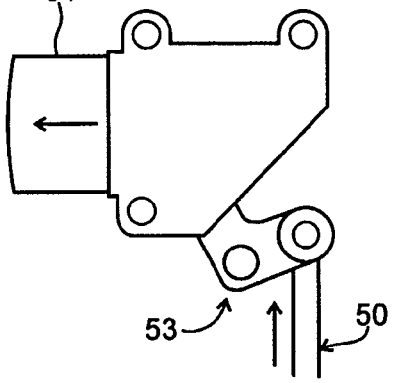
FIG. 5. Illustrates a remote lock in the locked position.
Figure 6:
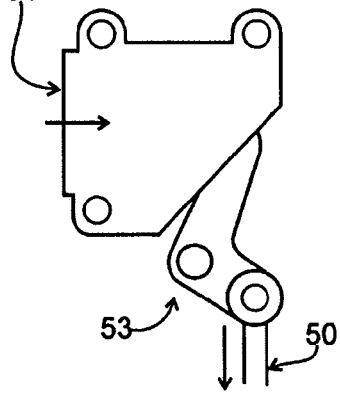
FIG. 6. Illustrates the remote lock of FIG. 5 in the unlocked position.
Figure 7:
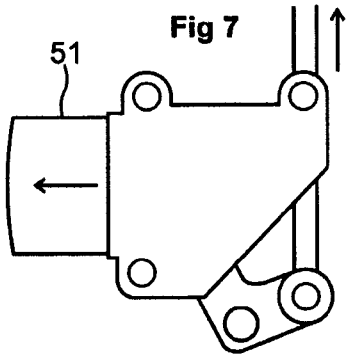
FIG. 7. Illustrates the remote lock from one side in the locked position and showing how the rod passes over part of the lock body.
Figure 9:
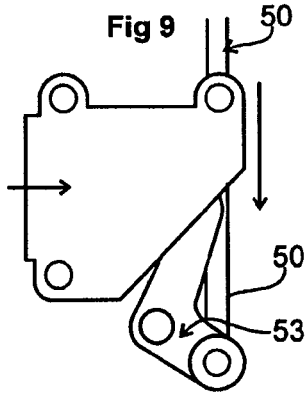
FIG. 9. Illustrates the lock of FIG. 7 moved to the unlocked position.
Figure 8:
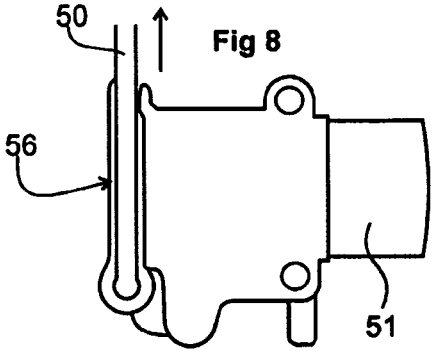
FIG. 8. Illustrates the remote lock of FIG. 7 from the other side and more clearly showing how the rod passes over the lock body.
Figure 10:
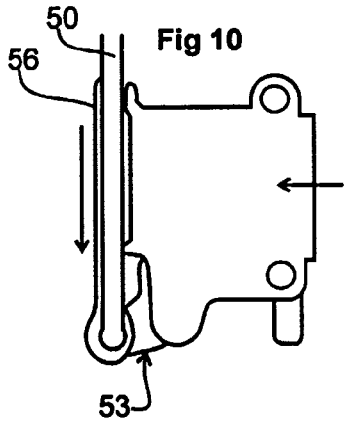
FIG. 10. Illustrates the lock of FIG. 9 moved to the unlocked position.
Figure 17:
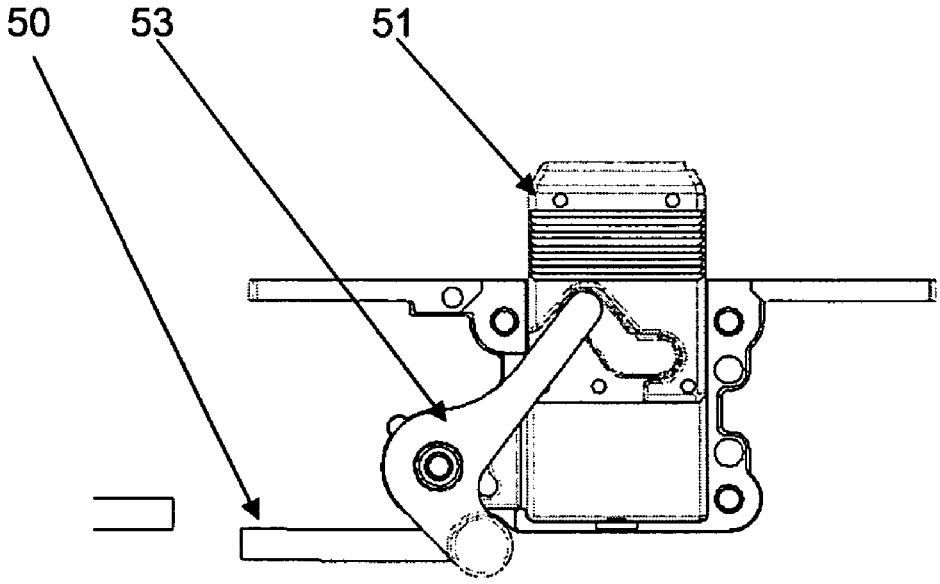
FIGS. 17 and 18. Illustrate a different type of remote lock with the rod in one position.
Figure 18:
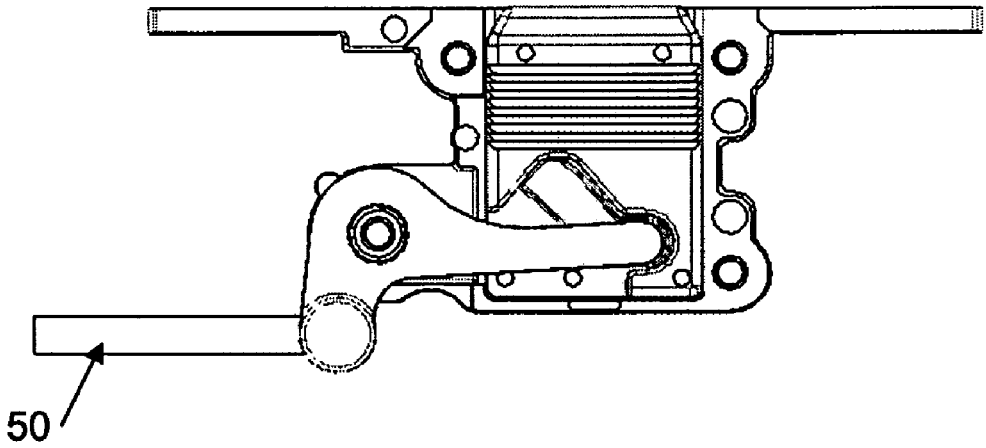
Figure 19:
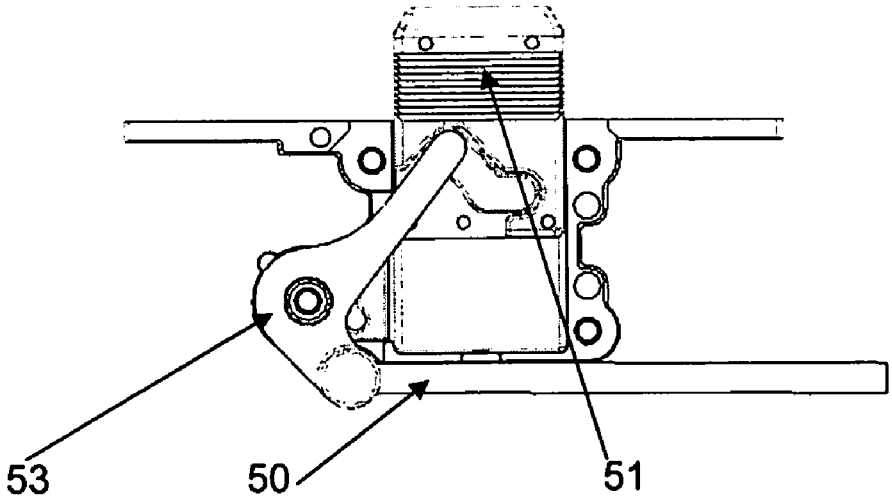
FIGS. 19 and 20.Illustrate the remote lock of FIG. 17 and FIG. 18 with the rod in the other position.
Figure 20:
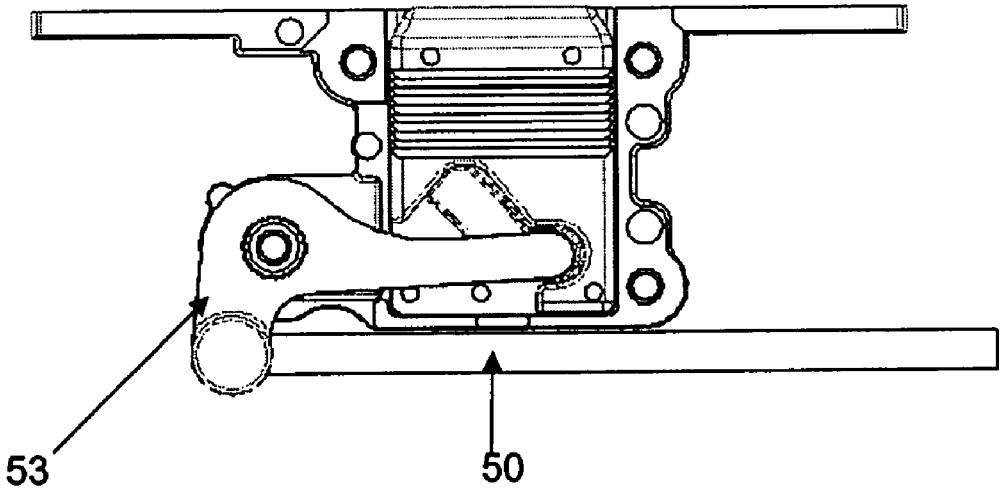

FIGS. 13-15 Illustrate variations to the attachment between the drive plate member and the deadlocking member. In FIG. 13, the drive plate member is provided with a socket/recess/channel 47 and the deadlocking member contains a projection 46 which fits into the socket/recess/channel, again with little or no lost motion. In FIG. 13, there is also illustrated that two components are press locked together as projection 46 is "arrow" shaped and engages with a similar shape on one wall of the socket 47.

FIG. 14 Illustrates a more robust arrangement where the deadlocking member is provided with a pair of projections. One projection fits within a socket on the drive plate member in such a way that there is little or no lost motion. The other projection is "arrow" shaped and engages with a corresponding shape on the drive plate member. Thus, the other projection can be pushed away from engagement to allow the drive plate member to be lifted away from the lock.

FIG. 15 illustrates a further variation which again has a pair of projections.

The drive plate member 24 in FIG. 1 and 40 in FIG. 11 extends slightly past the top and bottom of the lock and includes an attachment means to allow rods 50 to be attached to the drive plate member. Rods 50 can be any required length and function to operatively connect the drive plate member to the remote locks 11, 12.

The operation of the remote locks 11, 12 is best illustrated in FIG. 11 and FIG. 12. The remote locks are identical which means that is not necessary to manufacture different remote locks. Specifically, each remote lock is provided with a sliding tongue 51 which is in the extend deadlocking position in FIG. 11 and which is in the retracted unlocking position in FIG. 12. Tongue 51 slides within the lock housing. The rear part of tongue 51 includes an upstanding post 52 to which is attached an actuating arm 53. Actuating arm 53 is generally L-shaped in configuration and rocks or pivots about a pivot point 54. One arm portion of actuating arm 53 is provided with a profiled recess 55 which extends about post 52. The other arm portion of actuating arm 53 is pivotally connected to rod 50. Referring initially to remote lock II illustrated in FIG. 11 it can be seen that retraction of rod 50 will cause the actuating arm to pull lock tongue 51 back into the retracted position illustrated in FIG. 12. Conversely, extension of the rod from the position illustrated in FIG. 12 will cause the lock tongue 51 to extend to the locking position illustrated in FIG. 11. For lock tongue 11, rod 50 is connected to the actuating arm 53 and it is not necessary for rod 50 to extend over the top of the remote lock 11. However, referring now to lock 12, as lock 12 is the same as lock 11, by positioning lock 12 at the other end of the door, it can be seen that the actuating arm 53 is now on the other side of the remote lock body. Thus, in order for rod 50 to connect to the actuating arm 53, is necessary for the lock body to have a recess 56 (such as a channel or gutter) along which the rod can pass such that rod 50 can connect to actuating arm 53. By having the gutter or channel in the remote lock body, the rod can pass over the lock body without projecting from the lock body. This is best illustrated in FIG. 16 which shows how rod 50 does not project or extend from the confines of the remote lock body.

An advantage of this arrangement is that both remote locks will have their tongues extended and retracted together upon a simple sliding movement of the drive plate member 43. Movement of the drive plate member in one direction will cause one of the rods to push the remote lock into the lock position and will cause the other rod to pull the remote lock into the lock position. To allow the same lock design to work both in the upper part of the door and lower part of the door and in unison, and to allow the remote locks to be installed in the same orientation (i.e. not necessary to install one lock upside down) is necessary to provide the channel or gutter 56 to allow rod 50 to extend over the lock body to engage with the actuating arm 53.

FIGS. 5-10 illustrate the remote locks in greater detail.

FIG. 17-20 illustrate a different embodiment of the remote locks again showing how the connecting rods 50 can be turned by 180° to enable an upper and a lower remote lock to both extend together and retracted together upon operation of the remote lock operator on the rear of the main central lock.

Figure 21:
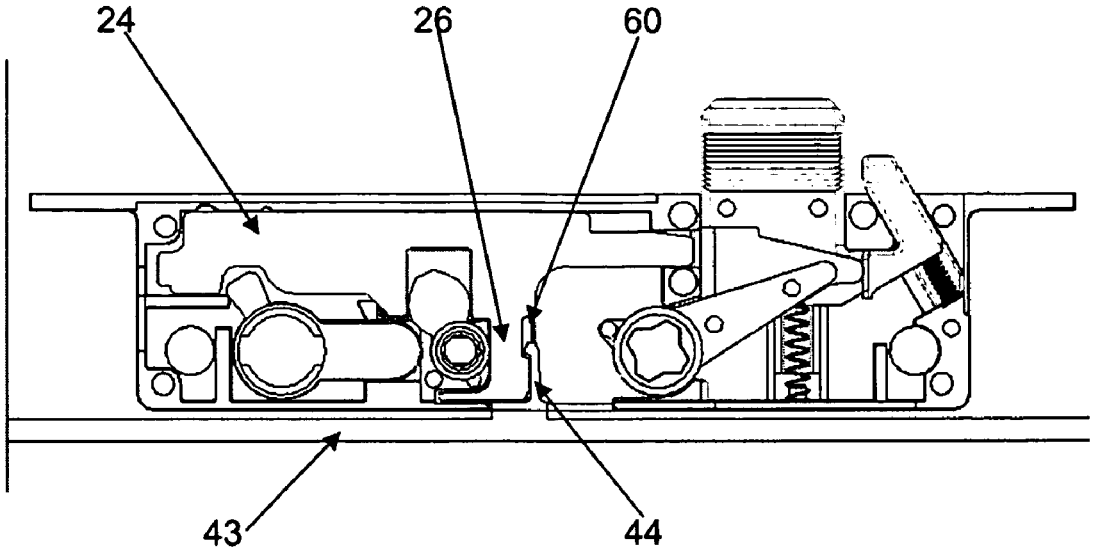
FIG. 21. Illustrates a lock according to an embodiment of the invention.

FIG. 21 illustrates a central lock showing the remote lock operator 43 provided with a projection 44 that has a "arrowhead" type configuration on the end of the projection. The deadlock 24 has a finger portion 26 provided with a recess or slot 60. The slot is configured to provide a "press fit" type arrangement between projection 44 and the slot which means that the remote lock operator 43 can be simply "snapped" into position on the rear of the lock.

FIGS. 22*a-c* illustrates a modified remote lock operator 43 which is on the back of the lock. The remote lock operator is provided with a second pin 62 that can also fit to the deadlocking member in the lock. This enables the remote lock operator 43 to be fitted to the lock at two different positions. Also illustrated, is that the remote lock operator is provided with terminal "outriggers" or projections 61. These are shaped and sized to substantially fill the void within the window or door stile. Projections 61 prevent any bending, buckling etc of the rather long and usually quite thin remote lock operator 33.

Another advantage of the invention is that the main lock (the central lock) can function as a multipoint lock to operate remote locks, but the same lock can be used as a "single" lock by removing the drive plate member from the rear of the lock body. There is no need to open up the lock body and to remove components therefrom.

It should be appreciated that various other changes and modifications can be made to the embodiment described without departing from the spirit and scope of the invention.

The invention claimed is:

1. A lock which is adaptable for use as a single standalone lock or as a central lock in a multipoint lock assembly which has one or more remote locks each of which is connected to the central lock with a substantially rigid remote lock operator, the lock including:

a lock body, a lock tongue that is movable between a locking position at which the lock tongue extends from the lock body and a free position at which the lock tongue is withdrawn at least partly into the lock body, an actuator the operation of which causes the lock tongue to move to the free position, and a deadlocking member in the lock body that is movable between a deadlocking position at which the deadlocking member deadlocks the lock tongue and an undeadlocking position at which the lock tongue is free to move relative to the deadlocking member, the deadlocking member having a portion that extends to adjacent a rear portion of the lock body and includes a rearwardly opening slot configured to receive with a press fit connection a forwardly extending projection on the remote lock operator for effecting longitudinal movement of the remote lock operator outside of the lock.

2. A lock as claimed in claim 1, wherein the forwardly extending projection includes a pin portion and an arrowhead portion and the rearwardly opening slot includes a first recess and a second recess, and wherein the first recess is configured to receive the pin portion, and the second recess is configured to have engaged with the arrowhead portion.

3. A lock as claimed in claim 1, comprising the remote lock operator connected to the deadlocking member, and further including at least one remote lock that is spaced a distance apart from the lock body, the at least one remote lock being connected to the remote lock operator with a connecting rod.

4. A lock as claimed in claim 3, wherein the at least one remote lock has a body, a locking tongue that is movable between a locking position at which the locking tongue extends from the body and an unlocking position at which the locking tongue is withdrawn into the body, an actuating member that operates the locking tongue between the locking position and the unlocking position, a second attachment member on the actuating member to enable the connecting rod to attach to the actuating member, and a recess in the body to accommodate the connecting rod and to enable the connecting rod to pass over the body without substantially projecting out of the confines of the body.

5. A lock as claimed in claim 4, wherein the remote lock operator comprises a sliding drive plate that is on the outside of the lock body and slides adjacent the rear portion of the lock body.

6. A lock as claimed in claim 5, wherein the remote lock operator is slidable between an upper position and a lower position on the rear of and relative to the lock body, and wherein movement of the remote lock operator between the upper and lower positions causes the at least one remote lock to move between the locking position and unlocking position.

7. A lock according to claim 3, wherein the forwardly extending projection on the remote lock operator is snapped into the rearwardly opening slot.

8. A lock according to claim 3, wherein the lock body has a rearwardly facing surface against which the remote lock operator is in sliding juxtaposition.

9. A lock according to claim 1, wherein the press fit connection is such that movement of the deadlocking member causes movement of the remote lock operator without any substantial loss of motion.

10. A lock according to claim 1, wherein the lock body includes an opening in a front side through which the lock tongue extends in the locking position and an opening through a rear side of the lock body through which the rearwardly opening slot is accessible.

11. A lock according to claim 1, wherein the rearwardly opening slot is configured so that the forwardly extending projection on the remote lock operator can be snapped into rearwardly opening slot.

12. A lock according to claim 1, wherein the lock body has a rearwardly facing surface against which the remote lock operator can slide when the forwardly extending projection on the remote lock operator is press fit in the rearwardly opening slot.

13. A lock as claimed in claim 1, comprising the remote lock operator, and further including at least one remote lock that is spaced a distance apart from the lock body, the at least one remote lock being connectable to the remote lock operator with a connecting rod.

14. A multipoint lock assembly having one or more remote latches connected to a central lock by a substantially rigid remote lock operator that has a first formation, the central lock including a lock body, a lock tongue that is movable between a locking position at which the lock tongue extends from the lock body and a free position at which the lock tongue is withdrawn at least partly into the lock body, an actuator the operation of which causes the lock tongue to move to the free position, and a deadlocking member in the lock body that is movable between a deadlocking position at which the deadlocking member deadlocks the lock tongue and an undeadlocking position at which the lock tongue is free to move relative to the deadlocking member, the deadlocking member having a portion that extends to adjacent a rear portion of the lock body and which includes a rearwardly opening slot, and wherein the remote lock operator has a forwardly extending projection received in the rearwardly opening slot with a press fit connection so that the remote lock operator moves longitudinally outside the lock.

* * * * *